US005720675A

United States Patent [19]

Shimosaka et al.

[11] Patent Number: 5,720,675

[45] Date of Patent: *Feb. 24, 1998

[54] GOLF BALL HAVING DENSELY ARRANGED DIMPLES

[75] Inventors: Hirotaka Shimosaka; Keisuke Ihara; Michio Inoue; Atuki Kasasima, all of Chichibu, Japan

[73] Assignee: Bridgestone Sports Co., Ltd., Tokyo, Japan

[ * ] Notice: The term of this patent shall not extend beyond the expiration date of Pat. No. 5,527,043.

[21] Appl. No.: 648,977

[22] Filed: May 17, 1996

[30] Foreign Application Priority Data

May 18, 1995 [JP] Japan ..... 7-144118

[51] Int. Cl.[6] ..... A63B 37/12

[52] U.S. Cl. ..... 473/384

[58] Field of Search ..... 473/383, 384

[56] References Cited

U.S. PATENT DOCUMENTS 5,527,043 6/1996 Shimosaka ..... 473/383 X

*Primary Examiner*—George J. Marlo

*Attorney, Agent, or Firm*—Sughrue, Mion, Zinn, Macpeak & Seas, PLLC

[57] ABSTRACT

A golf ball having a plurality of dimples formed in its surface and a diameter of 43 to 45 mm, wherein when a phantom great circle is depicted on the ball surface to divide the ball into two hemispheres and one hemisphere is developed by Lambert conformal projection to depict a planar expansion chart, the dimples are arranged to with respect to the planar expansion chart so as to meet the requirement (I) that when the planar expansion chart has a center 0, two large and small regular triangles AABC and Aabc centered at 0 are depicted on the chart with corresponding two apexes aligned with an identical radial line from center 0, and the respective sides of the small regular triangle Aabc are extended to intersect with the sides of the large regular triangle AABC to define one regular triangle coincident with the small regular triangle Aabc, three trapezoids, and three parallelograms, six dimples are contained in the one small regular triangle, nine dimples are contained in each of the trapezoids, and four dimples are contained in each of the parallelograms, with the proviso that where a dimple extends over any two or more of the small regular triangle, trapezoids and parallelograms, the dimple is regarded to belong to the region where at least 80% of the dimple area lies.

3 Claims, 8 Drawing Sheets

(A)

(B)

(A)

(B)

(A)

(B)

(A)

(B)

(A)

(B)

(A)

(B)

(A)

(B)

GOLF BALL HAVING DENSELY ARRANGED DIMPLES

BACKGROUND OF THE INVENTION

1. Field of the Invention

This invention relates to a large golf ball with a diameter of 43 to 45 mm having dimples densely arranged on its surface.

2. Prior Art

The flying performance of golf balls is greatly affected by the dimple arrangement. Various dimple arrangements are known in the art for arranging a plurality of dimples on the ball surface in an even or dense fashion.

Typical known dimple arrangements are regular polyhedral arrangements. It is also known to equally divide the hemisphere into one to seven sections, especially three to six sections from its center or pole.

The regular polyhedral arrangements include patterns using a regular tetrahedron, regular octahedron and regular eicosahedron. Although regular hexahedral and regular dodecahedral arrangements are also included, they are in the same phase as the regular octahedron and regular eicosahedron, respectively, that is, the only difference being an exchange of the apex and center of a plane. The regular tetrahedral arrangement is not commonly used. The regular polyhedral arrangement is obtained by designing one regular triangle and developing it over the entire surface although further smaller blocks are introduced depending on the position of a parting line. Therefore, the regular polyhedral arrangement requiring only to design several small blocks is simple, but the degree of freedom is low and the number of dimples is limited.

On the other hand, the method of equally dividing the hemisphere into one to seven sections from its pole has a high degree of freedom, but its design is complicated and much labor and efforts are required to evenly arrange dimples.

The small-size golf ball should have a diameter of not less than 41.15 mm and a weight of not greater than 45.93 grams as prescribed in the Rules of Golf. From the standpoint of flying performance, ordinary golf balls are formed as heavy as possible within the prescribed range. The large-size golf ball has a diameter of about 42.7 mm. Attention is recently paid to larger balls having a diameter of 43 mm or more because such large balls give a sense of security to the player upon shots and are seldom buried in sand and grass.

When dimples are arranged on the large diameter ball, the above-mentioned arrangement methods are employed. When the conventional arrangement methods, particularly the method of equally dividing the hemisphere from its pole, are applied to large diameter balls, it becomes more difficult to evenly arrange dimples. Symmetry is exacerbated by a parting line or the like. Then stable flying performance is sometimes lost because the carry and trajectory can slightly vary depending on the striking position of the ball.

SUMMARY OF THE INVENTION

Therefore, an object of the present invention is to provide a large diameter golf ball with a diameter of 43 to 45 mm wherein dimples are arranged in an even and dense distribution so that the ball has good symmetry.

The present invention provides a large diameter golf ball having a plurality of dimples formed in its surface and a diameter of 43 to 45 mm. When a phantom great circle is depicted on the ball surface to divide the ball into two hemispheres and one hemisphere is developed by Lambert conformal projection to depict a planar expansion chart, the dimples are arranged with respect to the planar expansion chart so as to meet the following requirement (I). When the planar expansion chart has a center O, two large and small regular triangles ΔABC and Δabc centered at O are depicted on the chart with corresponding two apexes aligned with an identical radial line from center O, and the respective sides of the small regular triangle Δabc are extended to intersect with the sides of the large regular triangle ΔABC to define one regular triangle coincident with the small regular triangle Δabc, three trapezoids, and three parallelograms, it is required (I) that six dimples be contained in the one small regular triangle, nine dimples be contained in each of the trapezoids, and four dimples be contained in each of the parallelograms. It is noted that where a dimple extends over any two or more of the small regular triangle, trapezoids and parallelograms, the dimple is regarded to belong to the region where at least 80% of the dimple area lies.

In one preferred embodiment, the dimples are arranged between the regular triangle AABC and the circumference of the planar expansion chart to meet the following requirements (II) and (III). When line segments OB and OC between apexes B and C of the regular triangle ΔABC and the center O are extended to intersect with the circumference at crossings P and Q, and points P', P", Q' and Q" are positioned along the circumference such that ∠P'BP" and ∠Q'CQ" are in the range of 60° to 120° and ∠PBP'=∠PBP"=∠QCQ'=∠QCQ", it is required (II) that dimples be arranged such that they do not intersect with segments BP', BP", CQ', and CQ", and nine to eleven dimples be arranged within a portion of a region BPQC lying adjacent side BC, and dimples are arranged from side BC toward arc PQ at a substantially equal spacing. When line segments OA and OB between apexes A and B of the regular triangle AABC and the center O are extended to intersect with the circumference at crossings R and P which define a region ARPB with apexes A and B, and line segments OC and OA between apexes C and A of the regular triangle ΔABC and the center O are extended to intersect with the circumference at crossings Q and R which define a region CQRA with apexes C and A, it is required (III) that dimples be arranged in each of the regions ARPB and CQRA in the same manner as in requirement (II).

Further preferably, dimples are arranged in a region ABPQCA such that when at least ten rows are defined in region ABPQCA from apex A toward arc PQ, the number of dimples from the first row to the tenth row increases from 1 to 10 by an increment of 1. This incremental array is recommended because of ease of dimple arrangement.

The dimple arrangement method of the invention is a simplification of the technique of dividing the hemisphere into three sections from its center or pole O. The size of large and small regular triangles can be arbitrarily selected and a choice may be made from many different dimple diameters. It is easy to arrange dimples in the respective blocks (small regular triangle, trapezoids, and parallelograms) while the dimples can be evenly distributed.

A simple procedure of properly determining the size of large and small regular triangles and suitably designing dimple arrangement in the remaining blocks can lead to an even dimple distribution in several blocks partitioned on the spherical surface. Typically 300 to 500 circular dimples are easily arranged on a large golf ball having a diameter of 43 to 45 mm.

According to the dimple arrangement of the invention, an even dimple distribution is easily accomplished even when the golf ball has a large diameter. The ball maintains good symmetry and ensures stable flying performance because the carry and trajectory little vary depending on the hit position of the ball. Although golf balls with a larger diameter tend to travel a higher trajectory, the large diameter golf ball having dimples arranged according to the invention will travel a relatively low trajectory. Quite unexpectedly, the carry is increased when average golfers with a head speed of 40 m/sec. hit the ball with a driver. The ball is thus suitable for those golfers who swing at a medium head speed.

BRIEF DESCRIPTION OF THE DRAWINGS

These and further features of the present invention will be apparent with reference to the following description and drawings, wherein.

DETAILED DESCRIPTION OF THE INVENTION

Figure 1:
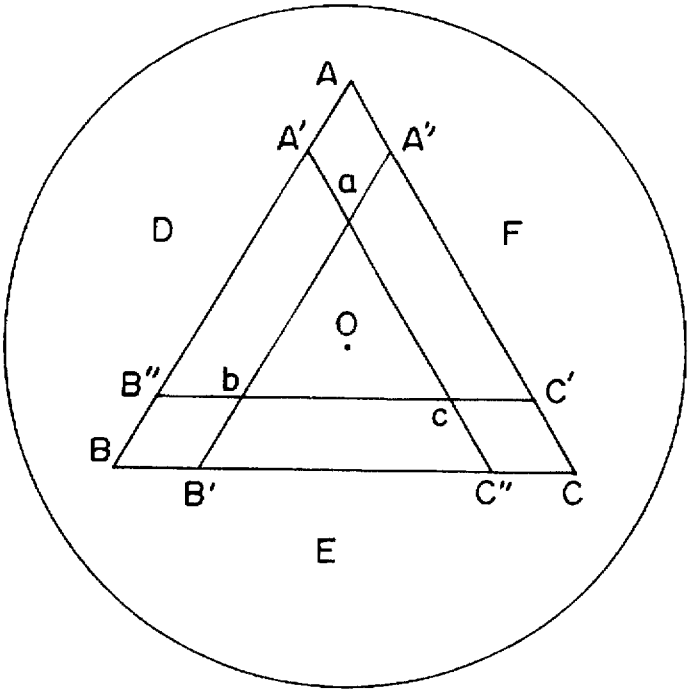
FIG. 1 is a planar expansion chart illustrating how to arrange dimples in ΔABC according to the invention.

Referring to FIG. 1, a planar expansion chart is shown to describe the procedure of arranging dimples on a large diameter golf ball having a diameter of 43 to 45 mm, especially 43.5 to 45 mm according to the invention. The planar expansion chart is obtained by depicting a phantom great circle on the golf ball surface to divide the ball into two hemispheres and developing one hemisphere by Lambert conformal projection.

With respect to the planar expansion chart, the dimple arrangement of the invention is defined as follows. The center of the planar expansion chart is designated at O. Two large and small regular triangles ΔABC and Δabc of an appropriate size and centered at O are depicted on the chart. Corresponding two apexes of triangles ΔABC and Δabc are aligned with an identical radial line from center O.

It is preferred that OA/R range from 0.60 to 0.82 wherein R is a radius of the circle, provided that 170 to 250 dimples having a diameter of 3.3 to 3.9 mm are distributed on the hemisphere.

Next, the respective sides ab, bc, and ca of the small regular triangle Δabc are extended to intersect with the sides CA, AB, and BC of the large regular triangle ΔABC at crossings A', B', C', A", B", and C". Then there are defined one regular triangle coincident with the small regular triangle Δabc, three trapezoids aA'B"b, bB'C"c, and cC'A"a, and three parallelograms (or rhombi) AA'aA", BB'bB", and CC'cC", that is, seven blocks in total.

It is required (I) that six dimples be contained in the one small regular triangle Aabc, nine dimples be contained in each of the trapezoids aA'B"b, bB'C"c, and cC'A"a, and four dimples be contained in each of the parallelograms AA'aA", BB'bB", and CC'cC". In total, 45 dimples (=6×1+9×3+4×3) are arranged within large and small regular triangles ΔABC and Δabc.

It is noted that where a dimple extends over any two or more of the small regular triangle, trapezoids and parallelograms, the dimple is regarded to belong to the region or block where at least 80% of the dimple area lies.

Next, dimples are properly arranged in the remaining regions D, E and F in the planar expansion chart. By projecting the dimple arrangement design onto a spherical surface (back projection of the expansion chart), there is obtained a dense distribution of about 300 to 500 dimples having a parting line.

When dimples are arranged in the above-mentioned blocks, it is preferred that dimples do not substantially intersect with the boundary lines of each block. It is permissible, however, to arrange dimples such that up to 20%, especially up to 10% of the dimples invade another block. It is noted that dimples have a circular planar shape though not limited thereto.

Figure 2:
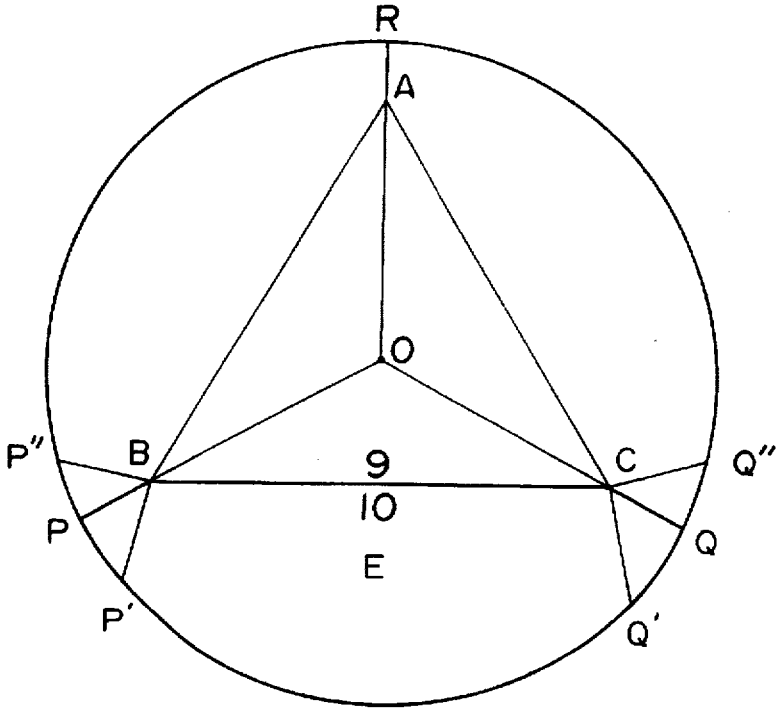
FIG. 2 is a planar expansion chart illustrating how to arrange dimples outside ΔABC according to the invention.

Preferably, the dimple arrangement in the regions outside ΔABC, that is, regions D, E and F in the planar expansion chart of FIG. 1 is done as described below in conjunction with FIG. 2. That is, the dimples are preferably arranged between the regular triangle ΔABC and the circumference of the planar expansion chart so as to meet requirements (II) and (III).

The dimple arrangement in region E is described. In FIG. 2, line segments OB and OC between apexes B and C of the regular triangle ΔABC and the center O are extended to intersect with the circumference at crossings P and Q. Region E is encompassed by BPQC. Points P', P", Q' and Q" are positioned along the circumference such that ∠P'BP" and ∠Q'CQ" are in the range of 60° to 120° and ∠PBP'=∠PBP"=∠QCQ'=∠QCQ". According to requirement (II), dimples are arranged such that they do not intersect with segments BP', BP", CQ', and CQ". Then, when a golf ball is formed, three lines are available in a region P"BCQ", for example, on the hemisphere in addition to the seam line. This corrects the unevenness of dimple arrangement resulting from dimples not intersecting with the seam line, achieving a well-balanced dimple arrangement.

Since nine dimples are contained in a row of ΔABC lying adjacent side BC, nine to eleven dimples, especially ten dimples be arranged within a row of a region E (=BPQC) lying adjacent side BC. Note that a dimple lying on line BP or CQ is calculated as ½. Dimples are thereafter arranged in rows from side BC toward arc PQ while maintaining the spacing between dimples substantially identical. Differently stated, dimples are more preferably arranged in rows in a region ABPQCA such that when at least ten rows are defined in region ABPQCA from apex A toward arc PQ, the number of dimples from the first row to the tenth row increases from 1 to 10 by an increment of 1, that is, in the order of 1, 2, 3, . . . , 9, 10. The number of dimples in the first row lying adjacent apex A is 1, the number of dimples in subsequent rows increases by an increment of 1, and the number of dimples in the tenth row is 10.

Similarly, line segments OA and OB between apexes A and B of the regular triangle ΔABC and the center O are extended to intersect with the circumference at crossings R and P which define a region ARPB with apexes A and B, and line segments OC and OA between apexes C and A of the regular triangle ΔABC and the center O are extended to intersect with the circumference at crossings Q and R which define a region CQRA with apexes C and A. According to requirement (III), dimples are arranged in each of the regions ARPB and CQRA in the same manner as in requirement (II).

The above mentioned dimple arrangement of the invention permits the size of large and small regular triangles ΔABC and Δabc to be arbitrarily selected to change the dimple diameter. In accordance with this arrangement, the dimple arrangement in the remaining regions D, E, and F can be easily determined, achieving an even and dense dimple distribution.

FIGS. 3 to 7 illustrate various exemplary golf balls with a diameter of 43 to 45 mm wherein dimples are arranged according to the array principle of the invention. In FIGS. 3 to 7, figure (A) shows dimples arranged on a planar expansion chart according to the array principle of the invention and figure (B) is a front elevational view obtained by projecting the planar expansion chart onto a spherical surface. Dimples are designated at 1. For the respective embodiments, the value of OA/R, number of dimples, and dimples' surface occupation are given below.

Figure 3:
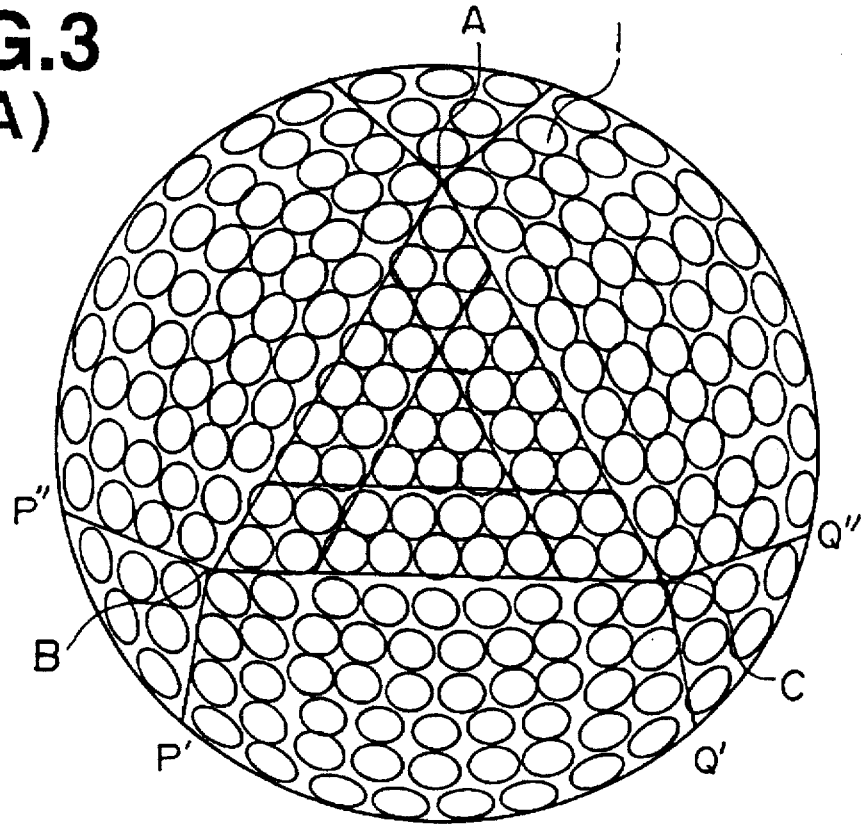
FIG. 3 illustrates a golf ball according to a first embodiment of the invention, FIG. 3(A) being a planar expansion chart and FIG. 3(B) being a front elevation.
Figure 3:
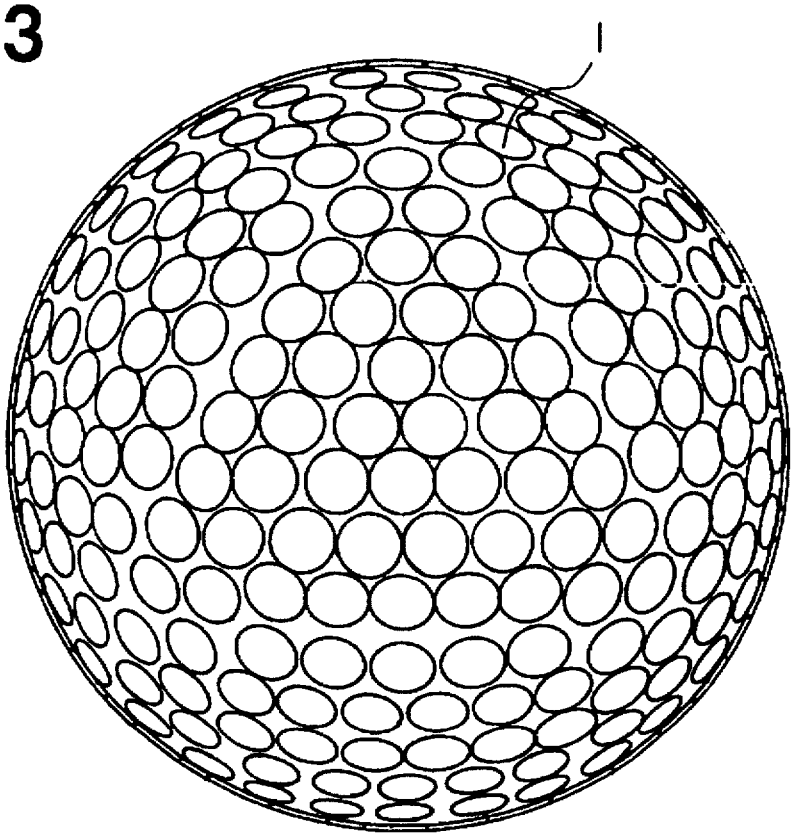
Figure 4:
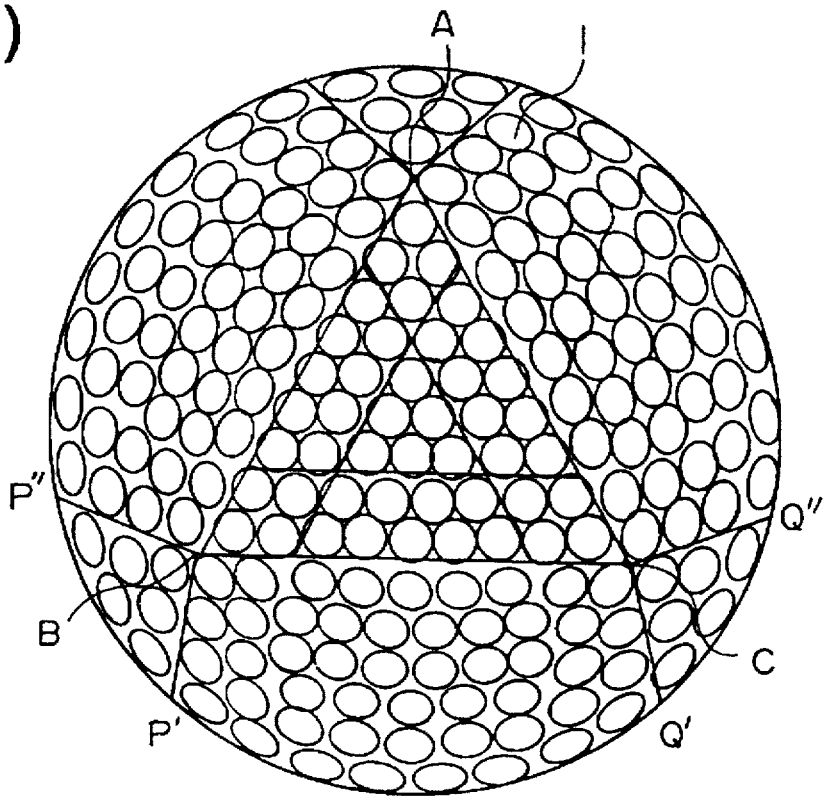
FIG. 4 illustrates a golf ball according to a second embodiment of the invention, FIG. 4(A) being a planar expansion chart and FIG. 4(B) being a front elevation.
Figure 4:
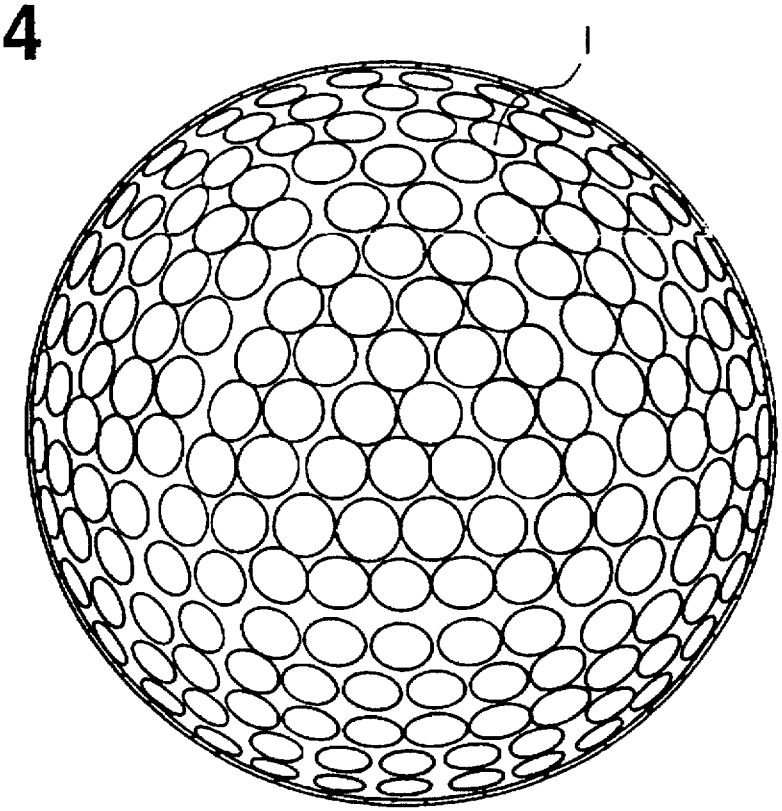
Figure 5:
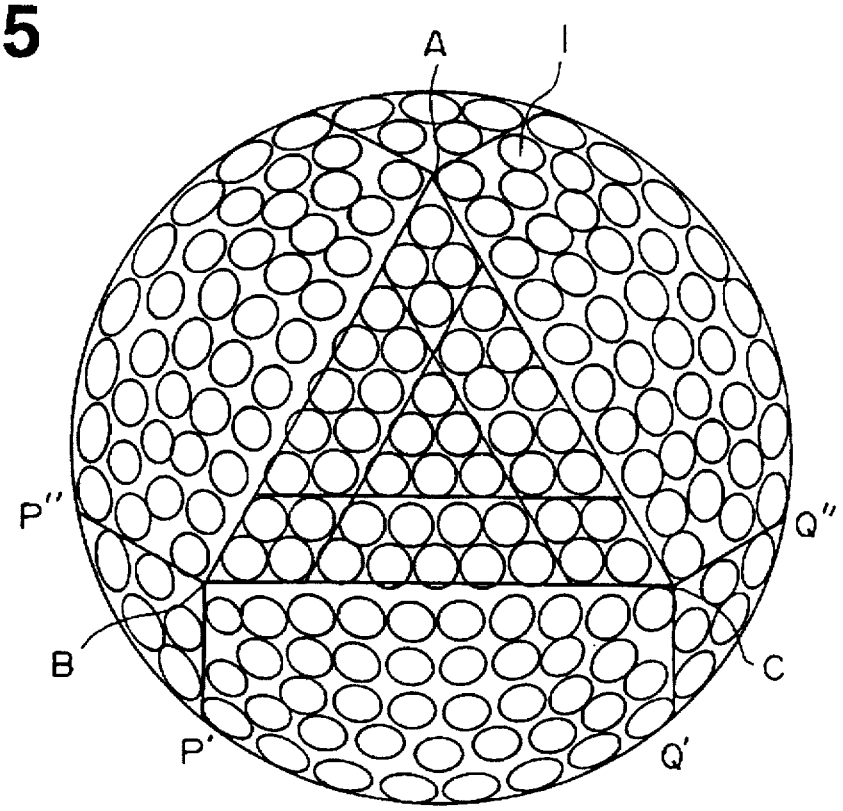
FIG. 5 illustrates a golf ball according to a third embodiment of the invention, FIG. 5(A) being a planar expansion chart and FIG. 5(B) being a front elevation.
Figure 5:
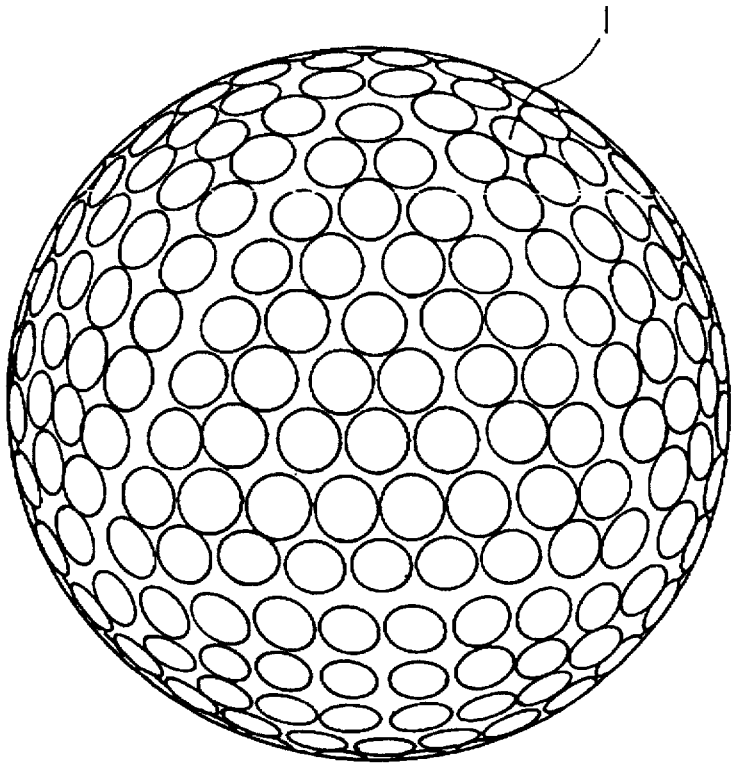
Figure 6:
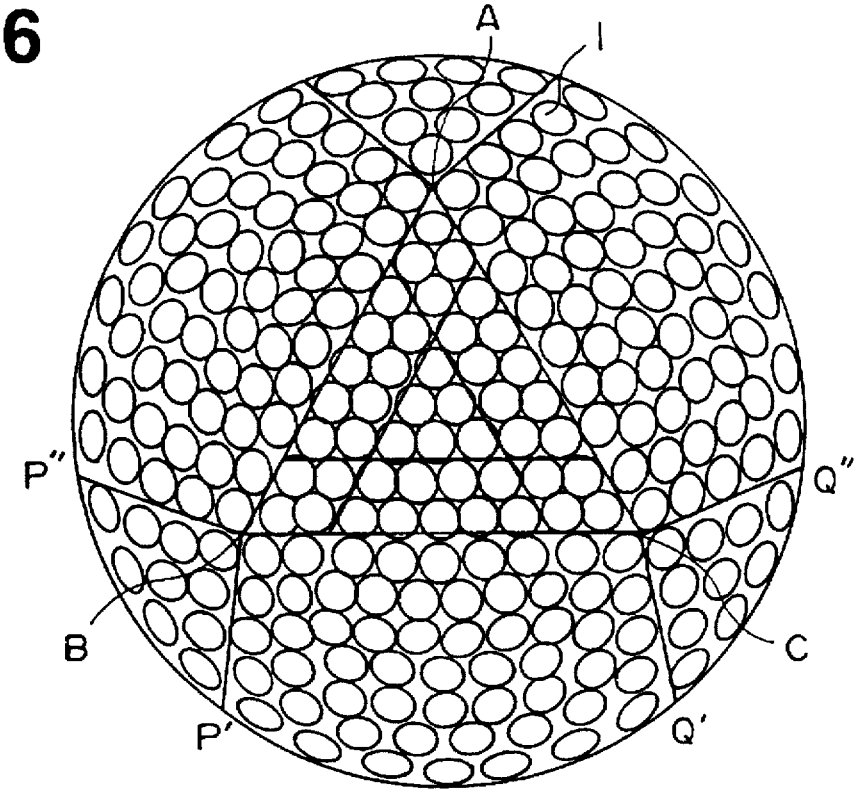
FIG. 6 illustrates a golf ball according to a fourth embodiment of the invention, FIG. 6(A) being a planar expansion chart and FIG. 6(B) being a front elevation.
Figure 6:
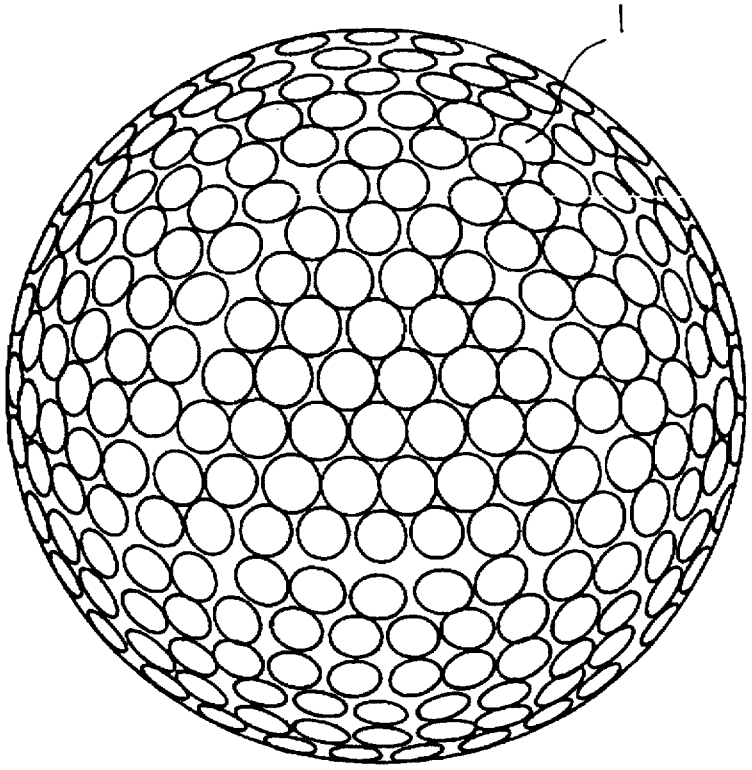
Figure 7:
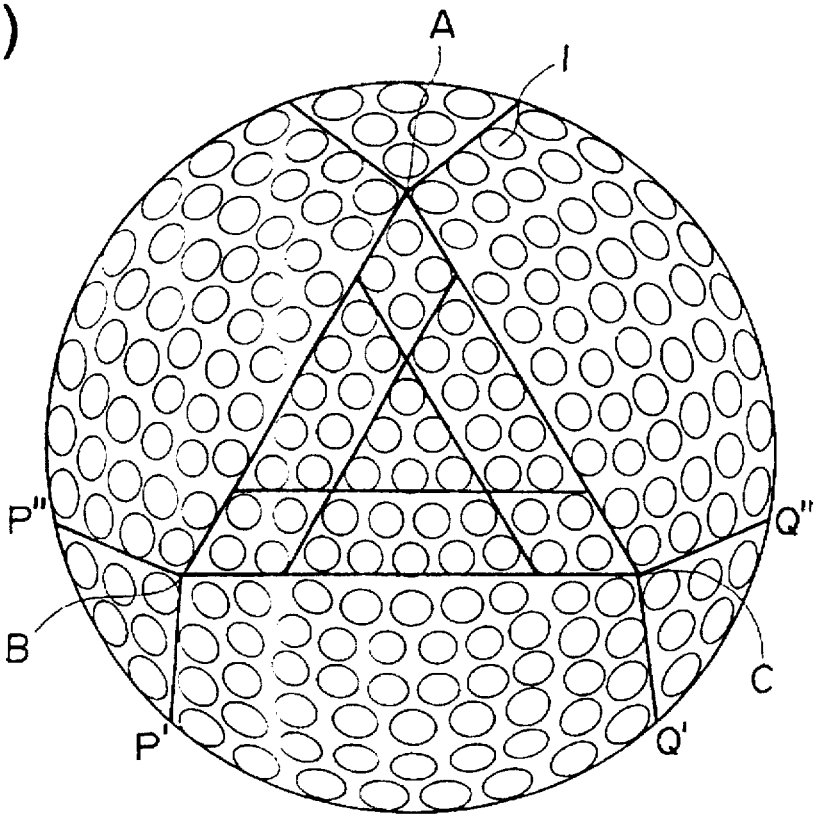
FIG. 7 illustrates a golf ball according to a fifth embodiment of the invention, FIG. 7(A) being a planar expansion chart and FIG. 7(B) being a front elevation.
Figure 7:
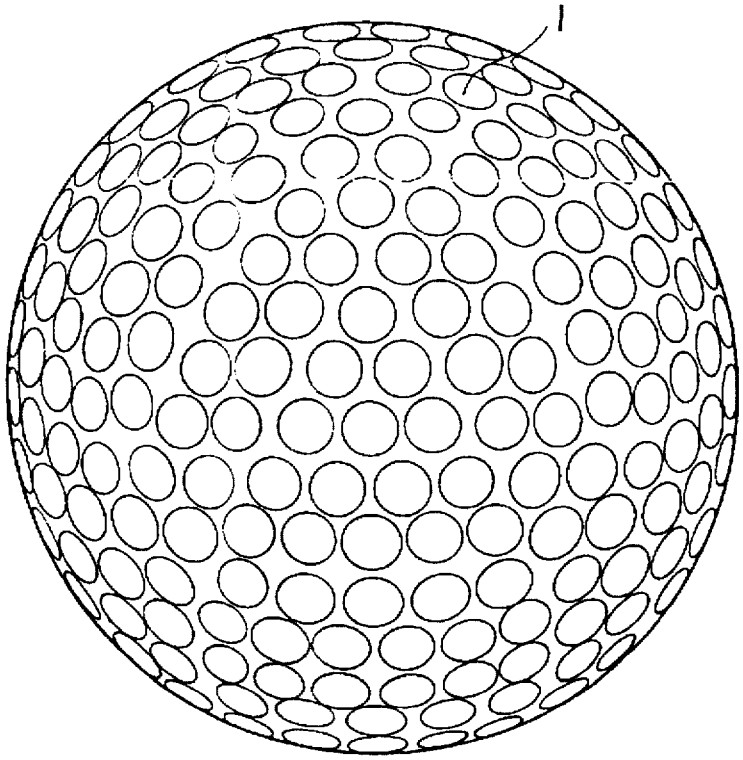

| | |
|---|---|
| Embodiment 1: FIG. 3 | |
| OA/R | 0.68 |
| Number of dimples | 210/hemisphere |
| Surface occupation | 70% |
| Number of dimple types | 1 |
| Embodiment 2: FIG. 4 | |
| OA/R | 0.68 |
| Number of dimples | 210/hemisphere |
| Surface occupation | 74% |
| Number of dimple types | 3 |
| Embodiment 3: FIG. 5 | |
| OA/R | 0.79 |
| Number of dimples | 183/hemisphere |
| Surface occupation | 69% |
| Number of dimple types | 2 |
| Embodiment 4: FIG. 6 | |
| OA/R | 0.64 |
| Number of dimples | 243/hemisphere |
| Surface occupation | 75% |
| Number of dimple types | 2 |
| Embodiment 5: FIG. 7 | |
| OA/R | 0.68 |
| Number of dimples | 210/hemisphere |
| Surface occupation | 61% |
| Number of dimple types | 2 |

These golf balls had a uniform distribution of dimples while their parting line was less conspicuous. The results of a hitting test showed that all the golf balls were improved in flying performance and symmetry.

It is understood that the golf balls of the invention may be solid golf balls such as one- and two-piece golf balls as well as wound golf balls. They can be manufactured by conventional methods. The weight of the golf ball should comply with the Rules of Golf although the invention is applicable to lightweight golf balls having a weight of 40 to 45 grams.

Experiment

Solid golf balls having a large diameter were manufactured and examined by a hitting test for comparing their flying performance and symmetry with a commercially available large diameter ball.

A core-forming rubber composition of the following formulation was vulcanized in a mold to form a core having an outer diameter of 39.7 mm, a weight of 34.5 grams, and a hardness of 3.23 mm as expressed by a distortion (mm) under a load of 100 kg.

| Core-forming composition | Parts by weight |
|---|---|
| Polybutadiene rubber | 85 |
| Natural rubber | 15 |
| Zinc diacrylate | 27 |
| Zinc oxide | 3 |
| Dicumyl peroxide | 1.5 |

Figure 9:
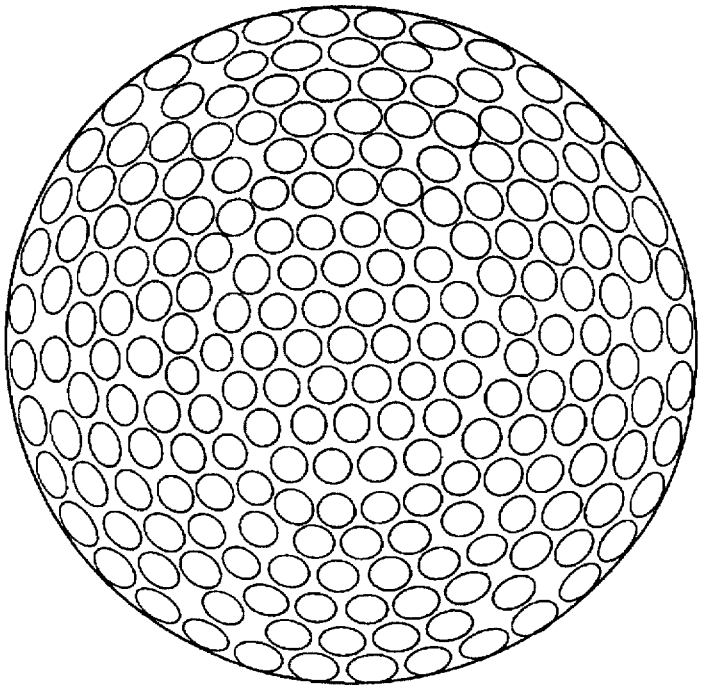
FIG. 9 illustrates the dimple arrangement of a commercially available large diameter golf ball as a comparison, FIG. 9(A) being a planar expansion chart and FIG. 9(B) being a front elevation.
Figure 9:
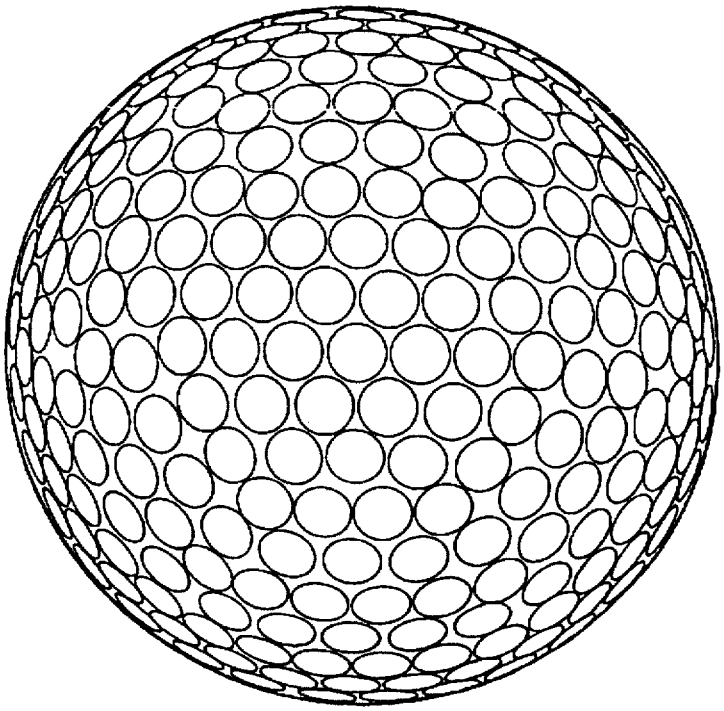

Next, an ionomer resin was injection molded over the core, obtaining a golf ball having an outer diameter, weight, hardness, and cover gage as reported in Table 1. The dimple arrangement was the same as in Embodiment 5 and FIG. 7 and contained two types of dimples having a diameter and depth as reported in Table 2. A commercially available large diameter ball was used as Comparative Example and its dimple arrangement is shown in FIG. 9.

TABLE 1

| | Outer diameter (mm) | Weight (g) | Hardness (mm) | Cover gage (mm) |
|---|---|---|---|---|
| Example 1 | 43.7 | 45.2 | 2.72 | 2.0 |
| Example 2 | 43.7 | 45.0 | 2.72 | 2.0 |
| Comparative Example | 43.5 | 45.5 | 2.58 | |

TABLE 2

| | First dimples | | Second dimples | |
|---|---|---|---|---|
| Example 1 | Diameter | 3.46 mm | Diameter | 3.20 mm |
| | Depth | 0.20 mm | Depth | 0.20 mm |
| | Number | 276 | Number | 138 |
| Example 2 | Diameter | 3.46 mm | Diameter | 3.20 mm |
| | Depth | 0.23 mm | Depth | 0.23 mm |
| | Number | 276 | Number | 138 |

Figure 8:
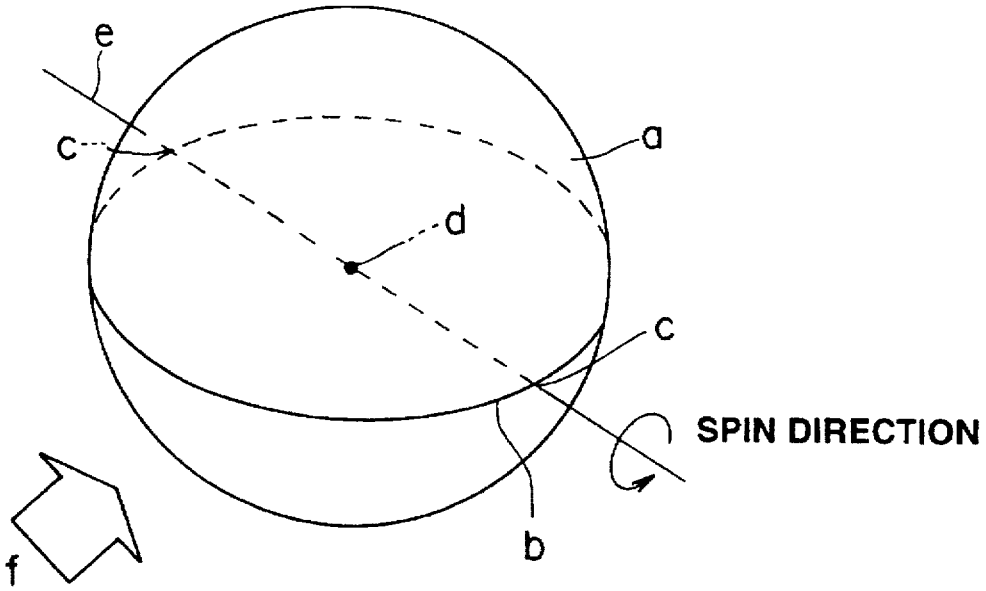
FIG. 8 illustrates the performance of the inventive ball when hit in a different striking direction, FIG. 8(A) corresponding to pole striking and FIG. 8(B) corresponding to seam striking.
Figure 8:
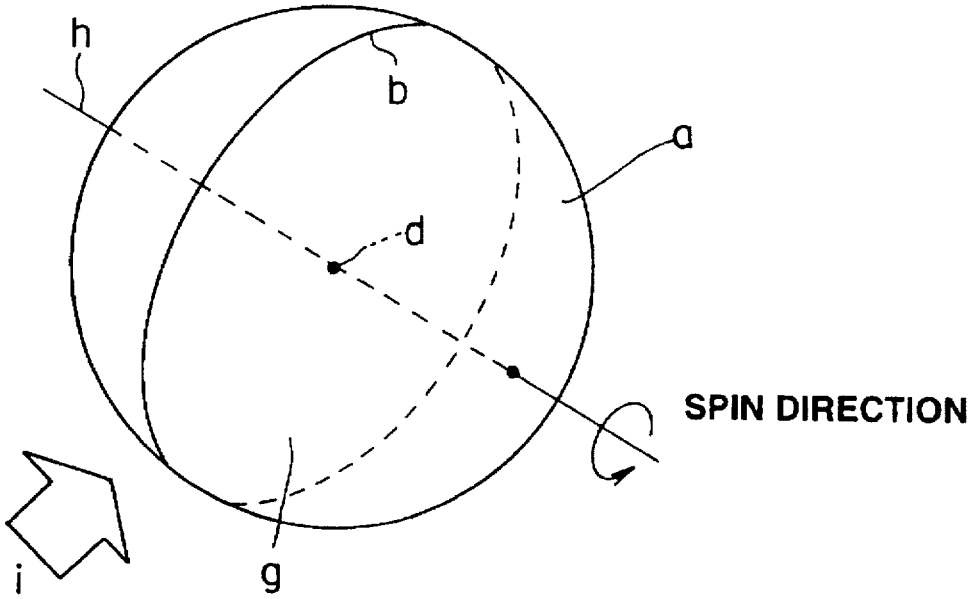

These golf balls were subject to a hitting test. The balls were repeatedly hit at a head speed (HS) of 45 m/sec. and 40 m/sec. by pole hitting (in the direction of an arrow in FIG. 8A) and seam hitting (in the direction of an arrow in FIG. 8B). The carry and total travel distance were measured, from which symmetry was calculated. The results are shown in Table 3 (head speed 45 m/sec.) and Table 4 (head speed 40 m/sec.). It is noted that the symmetry is represented by a difference in carry between pole hitting and seam hitting. A negative value of symmetry indicates that seam hitting gives a longer carry. Whether it is positive or negative, a smaller magnitude of symmetry indicates a less difference in carry between hit positions on the ball.

TABLE 3

| (HS 45 m/sec.) | Carry (m) | | Total travel |
|---|---|---|---|
| | Average | Symmetry | distance (m) |
| Example 1 | 211.1 | −1.5 | 221.9 |
| Example 2 | 207.6 | 0.3 | 221.5 |
| Comparative Example | 213.6 | 4.1 | 227.9 |

TABLE 4

| (HS 40 m/sec.) | Carry (m) | | Total travel |
|---|---|---|---|
| | Average | Symmetry | distance (m) |
| Example 1 | 179.8 | 1.8 | 191.8 |
| Example 2 | 179.0 | 0.8 | 188.5 |
| Comparative Example | 180.6 | −2.7 | 189.5 |

It is evident from Tables 3 and 4 that as compared with the commercially available large diameter ball, the golf balls of the invention (Examples 1 and 2) have improved aerodynamic symmetry since they exhibit a smaller magnitude of symmetry and their carry varies little depending on the position at which the ball is hit.

There has been described a large diameter golf ball which has improved symmetry as demonstrated by a least varying carry independent of the hit position of the ball and exhibits stable flying performance. Since dimples are arranged by equally dividing the hemisphere from the pole, a high degree of freedom is ensured for dimple arrangement.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a plurality of dimples formed in its surface and a diameter of 43 to 45 mm, wherein when a phantom great circle is depicted on the ball surface to divide the ball into two hemispheres and one hemisphere is developed by Lambert conformal projection to depict a planar expansion chart, the dimples are arranged with respect to the planar expansion chart so as to meet the requirement (I) that when the planar expansion chart has a center O, two large and small regular triangles ΔABC and Δabc centered at O are depicted on the chart with corresponding two apexes aligned with an identical radial line from center O, and the respective sides of the small regular triangle Δabc are extended to intersect with the sides of the large regular triangle ΔABC to define one regular triangle coincident with the small regular triangle Δabc, three trapezoids, and three parallelograms, six dimples are contained in the one small regular triangle, nine dimples are contained in each of the trapezoids, and four dimples are contained in each of the parallelograms, with the proviso that where a dimple extends over any two or more of the small regular triangle, trapezoids and parallelograms, the dimple is regarded to belong to the region where at least 80% of the dimple area lies.

2. The golf ball of claim 1 wherein the dimples are arranged between the regular triangle ΔABC and the circumference of the planar expansion chart so as to meet the requirement (II) that when line segments OB and OC between apexes B and C of the regular triangle ΔABC and the center O are extended to intersect with the circumference at crossings P and Q, and points P', P", Q' and Q" are positioned along the circumference such that ∠P'BP" and ∠Q'CQ" are in the range of 60° to 120° and ∠PBP'=∠PBP"=∠QCQ'=∠QCQ", dimples are arranged such that they do not intersect with segments BP', BP", CQ', and CQ", and nine to eleven dimples are arranged within a portion of a region BPQC lying adjacent side BC, and dimples are arranged from side BC toward arc PQ at a substantially equal spacing, and the requirement (III) that when line segments OA and OB between apexes A and B of the regular triangle ΔABC and the center O are extended to intersect with the circumference at crossings R and P which define a region ARPB with apexes A and B, and line segments OC and OA between apexes C and A of the regular triangle ΔABC and the center O are extended to intersect with the circumference at crossings Q and R which define a region CQRA with apexes C and A, dimples are arranged in each of the regions ARPB and CQRA in the same manner as in requirement (II).

3. The large diameter golf ball of claim 2 wherein dimples are arranged in a region ABPQCA such that the number of dimples from a first section to a tenth section defined in region ABPQCA from apex A toward arc PQ increases from 1 to 10 by an increment of 1.

* * * * *